US005437830A

United States Patent [19]

Calandra, Jr. et al.

[11] Patent Number: 5,437,830

[45] Date of Patent: Aug. 1, 1995

[54] PROCESS OF MAKING A ROD FOR USE IN REINFORCING AN UNDERGROUND ROCK FORMATION

[75] Inventors: Frank Calandra, Jr., Pittsburgh; John C. Stankus, Canonsburg; John G. Oldsen, Butler, all of Pa.

[73] Assignee: Jenmar Corporation, Pittsburgh, Pa.

[21] Appl. No.: 176,724

[22] Filed: Jan. 3, 1994

Related U.S. Application Data

[62] Division of Ser. No. 4,076, Jan. 13, 1993, Pat. No. 5,314,268.

[51] Int. Cl.[6] ..... B29C 43/14

[52] U.S. Cl. ..... 264/296; 264/322

[58] Field of Search ..... 264/296, 322

[56] References Cited

U.S. PATENT DOCUMENTS

| | | | |
|---|---|---|---|
| 2,850,937 | 9/1958 | Ralston . | |
| 3,238,731 | 3/1966 | Seifert et al. . | |
| 3,478,523 | 11/1969 | Reusser et al. . | |
| 4,140,428 | 2/1979 | McLain et al. | 405/261 |
| 4,289,427 | 9/1981 | Rolston | 405/259.5 |
| 4,307,979 | 12/1981 | Killmeyer | 405/259.1 |
| 4,369,003 | 1/1983 | Brandstetter | 405/260 |
| 4,395,161 | 7/1983 | Wilson et al. | 405/259.1 |
| 4,413,930 | 11/1983 | Calandra, Jr. | 405/261 |
| 4,419,805 | 12/1983 | Calandra, Jr. | 29/458 |
| 4,516,885 | 5/1985 | Calandra, Jr. | 405/261 |
| 4,518,292 | 5/1985 | Calandra, Jr. | 411/82 |
| 4,784,531 | 11/1988 | Calandra, Jr. | 405/261 |
| 4,940,365 | 7/1990 | Rozanc | 405/261 |
| 4,958,961 | 9/1990 | Herbst et al. | 405/259.5 |
| 5,064,311 | 11/1991 | Giroux et al. | 405/259.1 |

FOREIGN PATENT DOCUMENTS

| | | |
|---|---|---|
| 0006520 | 1/1980 | European Pat. Off. . |
| 0258477 | 3/1988 | European Pat. Off. . |
| 2718417 | 11/1978 | Germany . |
| 981555 | 1/1965 | United Kingdom . |
| 2153949 | 8/1985 | United Kingdom . |

*Primary Examiner*—Leo B. Tentoni
*Attorney, Agent, or Firm*—Webb Ziesenheim Bruening Logsdon Orkin & Hanson

[57] ABSTRACT

An elongated rod fabricated of polymeric material for use in reinforcing an underground passage includes an integral structure of a shaft portion, washer element and torque receiving end portion. The shaft portion is fabricated of a preselected polymeric material as required to meet the strength requirements of the rod in reinforcing the rock formation surrounding the passage. For use in reinforcing the side walls of a passage, the rod is fabricated of plastic material recycled, for example, from plastic beverage containers. The integral construction eliminates the need to thread the end of the rod to receive a nut. The washer element seats against a bearing block compressed against the side wall. When used with a resin system, the rod is anchored in the bore hole to maintain the bearing block compressed against the side wall to support the surrounding rock strata.

3 Claims, 3 Drawing Sheets

PROCESS OF MAKING A ROD FOR USE IN REINFORCING AN UNDERGROUND ROCK FORMATION

CROSS REFERENCE TO RELATED APPLICATION

This application is a division of U.S. application Ser. No. 004,076 filed Jan. 13, 1993 entitled "Non-Metallic Reinforcing Rod And Method Of Use In Supporting A Rock Formation", now U.S. Pat. No 5,314,268.

BACKGROUND OF THE INVENTION 1. Field of the Invention

This invention relates to a rod fabricated of non-metallic material for use in supporting the rock formation surrounding an underground passage and, more particularly, to a reinforcing rod fabricated of polymeric material including at one end portion an integral washer element and retainer for receiving torque to rotate the rod when inserted in a bore hole in the rock formation.

2. Description of the Prior Art

In underground operations, such as mining or excavating, one approach to reinforcing the unsupported rock formation is the use of elongated reinforcing rods or bolt members anchored in holes drilled into the rock formation. The bolt member is secured in the bore hole by either engagement of an expansion shell on the end of the bolt with the rock formation or adhesively bonding the bolt by a thermosetting resin injected into the drill hole so that upon curing the bolt member is united with the rock formation. A combination of a mechanical expansion shell and resin bonding is also used in support systems.

A roof plate is retained on the bolt by an enlarged head formed on the bolt or by a nut that is advanced onto the threaded end of the bolt. When an expansion shell is used, the bolt is tensioned with the affect of compressing the rock strata to reinforce the rock strata. When adhesive is used to bond the bolt in the bore hole the resin components are mixed by rotation of the bolt in the bore hole. The mixed resin penetrates into the rock formation to adhesively unite fissures in the rock formation and to firmly hold the bolt in position in the bore hole once the resin cures.

Examples of metallic roof bolts using a combination expansion shell and resin to reinforce a rock formation are disclosed in U.S. Pat. Nos. 4,419,805; 4,413,930; 4,518,292; and 4,516,885. These devices can utilize a metallic roof bolt or reinforcing rod having an enlarged head end forged on the end of the rod that extends from the bore hole. The enlarged head end bears against a metallic roof plate when the bolt is anchored and tensioned to transmit compressive forces to the overlying rock structure. In the alternative, the end portion of the roof bolt is threaded to accommodate a nut. The bearing plate is positioned on the end of the bolt, and then the nut is advanced on the threaded end to hold the bearing plate on the end of the bolt and compressed against the rock structure.

It is also known to reinforce underground rock formations with rods or bolts fabricated of non-metallic material, such as plastic. U.S. Pat. No. 4,369,003 discloses a rock anchor formed of a tubular tensioning element fabricated of glass fiber reinforced synthetic resin. The tensioning element is anchored within the bore hole by a jacket that is spread by a conical wedge, also fabricated of glass fiber reinforced synthetic resin.

The opposite end of the tensioning element which extends from the bore hole includes an externally threaded jacket that is wedged in place on the end of the tensioning element. A metallic anchor plate is positioned on the threaded portion of the tensioning jacket. A clamp nut is threadedly advanced on the end of the jacket to compress the plate against the rock formation. One disadvantage of this type of anchor assembly is the complexity provided by a number of components which must be inventoried and provided for assembly of each anchor. A particular disadvantage is the necessity to thread the end of the plastic anchor to receive a nut without stripping the threads.

U.S. Pat. No. 4,369,003 also discloses that rather than use a fiber glass reinforced spreading jacket, an externally threaded metal spreading jacket may be more efficient to receive a nut to securely retain the anchor plate on the end of the bolt.

It is also known to fabricate high strength non-metallic anchor bolts from materials, such as glass fiber reinforced synesthetic resin. High strength "plastic bolts" are also externally threaded to receive a plastic nut. In many reinforcing applications it is not necessary that the bolt possess the high strength qualities provided by glass fiber reinforced synesthetic resin. Where lesser strength requirements permit polymeric materials having a strength of about 15–25% of glass fiber reinforced bolts can be used.

While it has been suggested by the prior art devices to provide reinforcing roof bolts and rods fabricated of non-metallic material for use ill anchoring rock formations and underground excavations, the known non-metallic rods are expensive to fabricate due to their composition and the number of component parts required. Therefore, there is need in supporting underground rock formations for a non-metallic reinforcing rod or bolt that is economically fabricated and efficiently installed for the particular strength requirements in supporting the rock formation.

SUMMARY OF THE INVENTION

In accordance with the present invention there is provided apparatus for reinforcing an underground passage that includes an elongated rod fabricated of polymeric material and having a preselected length for insertion into a hole bored a preselected depth into a rock formation surrounding the underground passage. The rod has an anchoring end portion for insertion in the bore hole and a tensioning end portion extending out of the bore hole. The rod has a substantially uniform cross sectional area along the length thereof between the anchoring end portion and the tensioning end portion. Retaining means extends from the tensioning end portion for transmitting torque to the rod. The retaining means is fabricated of polymeric material and formed integrally with the rod tensioning end portion. A bearing block have an opening therethrough receives the rod with the retaining means abutting the bearing block around the opening to maintain the bearing block on the rod. Means is positioned in the bore hole surrounding the rod anchoring end portion for retaining the rod in the bore hole to compress the bearing block against the rock formation to reinforce the rock formation surrounding the bore hole.

Further, in accordance with the present invention there is provided a reinforcing bolt that includes an elongated shaft having a body portion fabricated of polymeric material. The shaft body portion has a first end portion and a second end portion with a substantially uniform cross sectional area between the first and second end portions. A washer element of polymeric material is formed integral with and extends from the first end portion of the shaft body portion. The washer element has a semi-spherical surface extending axially and outwardly from the first end portion. Means is provided for receiving torque applied to the first end portion of the shaft body portion. The torque receiving means is formed of polymeric material integrally with the washer element. The torque receiving means extends coaxially relative to the washer element for receiving torque to transmit rotation to the shaft.

Further, in accordance with the present invention there is provided a method for fabricating a rod for use in reinforcing an underground rock formation that includes the steps of molding polymeric material to form an elongated shaft having a body portion of substantially uniform cross sectional area along the length thereof. One end portion of the rod is formed for insertion in the bore hole of the underground rock formation and a second end portion for extending out of the bore hole. A washer element is formed integrally of polymeric material on the shaft second end portion and has a semispherical surface facing the shaft second end portion. A retainer for receiving torque to transmit rotation to the shaft when positioned in a bore hole of the underground rock formation is formed integrally of polymeric material with the washer element.

Accordingly, a principal object of the present invention is to provide a non-metallic reinforcing member for use in supporting a wide variety of rock formations and underground excavations.

Another object of the present invention is to provide a reinforcing rod fabricated of a preselected polymeric material for use in reinforcing an underground rock formation in which the rod has an integral cap or washer element for retaining a bearing block on the end of the rod against the rock formation to obviate the need for threading the end of the bolt to receive a threaded nut to retain the bearing block on the rod.

A further object of the present invention is to provide a process for forming an elongated anchor member fabricated of polymeric material and having an integral enlarged end portion for retaining a bearing block on the end of the anchor member and for receiving torque to transmit rotation to the anchor member upon installation in a bore hole of a rock formation.

An additional object of the present invention is to provide an anchor bolt fabricated of recycled plastic material, such as nylon or polyethylene terathalate, including an integral construction of shaft portions, washer element and torque receiving end portion and having a material strength to reinforce a rock formation.

A further object of the present invention is to provide a method for supporting an underground rock formation during a mine material dislodging operation where a plastic anchor installed in the rock formation may be destroyed by a shearer or cutter during the material dislodging operation without damaging the cutting elements of the mining machine.

These and other objects of the present invention will be more completely disclosed and described in the following specification, accompanying drawings, and appended claims.

DESCRIPTION OF THE PREFERRED EMBODIMENTS

Figure 1:
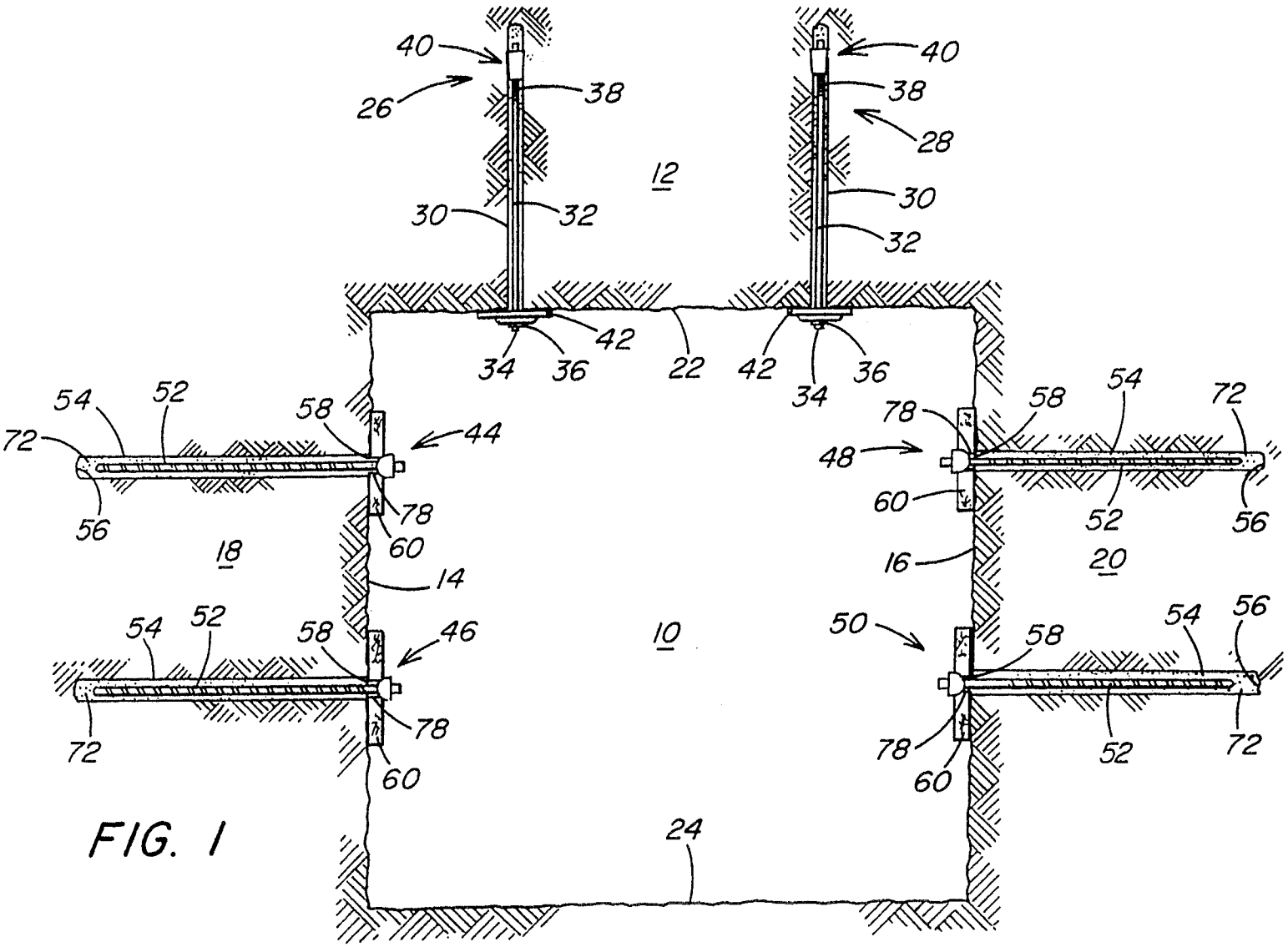
FIG. 1 is a schematic, sectional view of an underground passageway, illustrating a pair of conventional anchor bolts supporting the mine roof and a plurality of non-metallic anchor rods in accordance with the present invention supporting tile side walls or ribs of the passageway.

Referring to the drawings and particularly to FIG. 1, there is illustrated an underground excavation 10, such as a passageway, cut in a rock formation 12 by conventional mining methods to extract solid material, such as coal, therefrom in a mining operation. The passageway 10 is defined by oppositely positioned side walls 14 and 16 formed by ribs or pillars 18 and 20 that extend between a roof 22 of the passageway 10 and a floor 24 thereof. The portion of the rock formation 12 above the roof 22 is supported by conventional metallic roof bolt assemblies generally designated by the numerals 26 and 28.

Each of the assemblies 26 and 28 is inserted in bore holes 30 drilled through the surface of the roof 22 to a preselected depth into the rock formation 12. For example, the bore holes 30 are drilled a distance of six to seven feet into the mine roof.

The roof bolt assemblies 26 and 28 are conventional and include an elongated roof bolt 32 fabricated of metal material having an enlarged head 34 with a washer 36 at one end and an opposite threaded end portion 38. A mechanical expansion shell assembly generally designated by the numeral 40 is threadedly engaged to the bolt end portion 38. As well known, upon rotation of the bolt 32 in the bore hole 30, the shell assembly 40 is expanded into gripping engagement with the wall of the bore hole to exert tension on the bolt 32 with the bolt end portion 34 bearing against a metallic roof plate 42 abutting the surface of the roof 22. With this arrangement, he rock strata is maintained in compression to support the roof 22 above the passageway 10. To increase the anchorage of the roof bolt assemblies 26 and 28 within the bore holes 30, resin is used in combination with the assemblies 26 and 28. The resin adds additional strength to the anchorage of the bolts 32 in the bore holes 30.

The bolts 32 used to secure the expansion shell assemblies 40 within the bore hole of the mine roof are fabricated of metallic material, such as rebar material varying in diameter as determined by the diameter of the bore hole. For example, typical diameters for rebar used for the bolts 32 vary from $\frac{5}{8}$ to $\frac{3}{4}$ inches in a one inch bore hole. The diameter of the rebar is selective as determined by the diameter of the bore hole which exceeds the diameter of the rebar. Also, the roof plates 42 are fabricated of metallic material and are operable to exert a compressive force on the rock strata of the roof 22 when the anchored roof bolts are placed in tension. Once the expansion shell assemblies 40 are engaged to the rock formation, the bolts 32 are tensioned to a preselected magnitude by applying torque to the bolt end portions 34.

In accordance with the present invention, the pillars or ribs 18 and 20 at the side walls 14 and 16 of the underground passageway 10 are supported by a plurality of anchor assemblies 44, 46, 48 and 50. As illustrated in FIG. 1, a pair of anchor assemblies are engaged to each side wall 14 and 16. The pairs of anchor assemblies 44, 46 and 48, 50 are positioned a preselected distant apart relative to the roof 22 and floor 24. However, it should be understood that any number of anchor assemblies may be secured to the side walls 14 and 16 in a preselected pattern and a preselected distance apart, based on the dimensions of the passageway 10.

Figure 2:
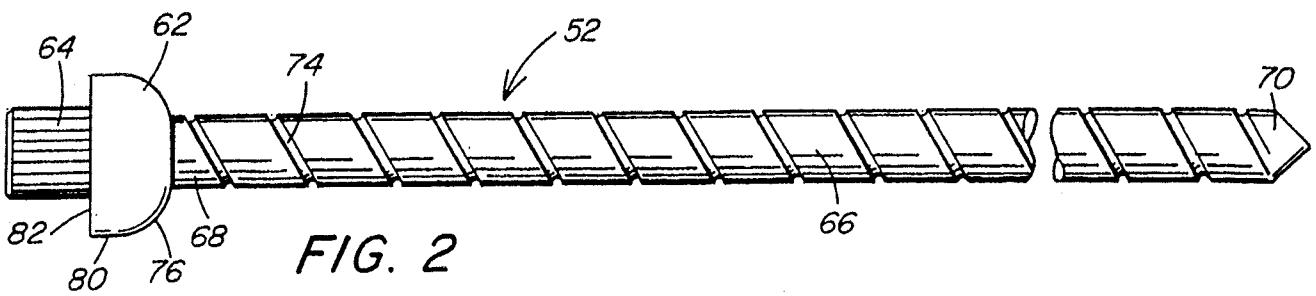
FIG. 2 is a fragmentary view in side elevation of a plastic anchor rod, illustrating a semi-spherical washer element and a torque receiving end portion formed integrally with the shaft portion having an extended surface, such as a spiral groove extending along the length thereof.
Figure 3:
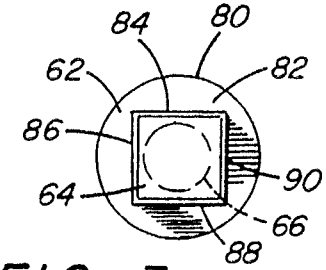
FIG. 3 is an end view of an anchor rod shown in FIG. 2, illustrating the integral structure of the shaft portion, washer element and torque receiving end portion.

Each anchor assembly 44–50 is preferably of similar construction and includes for example, as illustrated in FIGS. 2 and 3, an elongated reinforcing bar or rod 52 fabricated of polymeric material of a preselected length for insertion into a bore hole 54 drilled a preselected depth into the rock formation forming the ribs 18 and 20. Accordingly, each bore hole 54 has a blind or closed end portion 56 and an open end portion 58 at the surface of the respective side wall 14, 16. The bore holes 54 are drilled in the rock formation using conventional rock drills. The bore holes 54 are drilled as a part of the primary mining cycle in the formation of the passageway 10. Alternatively, the bore holes 54 are drilled for installation of the anchor assemblies 44–50 at any time after the formation of the passageway 10 to provide additional support of the mine ribs 18 and 20.

The anchor assemblies 44–50 are installed with bearing blocks 60 positioned on each rod 52 to abut the surface of the side walls 14, 16 around the bore hole openings 58. Each of the elongated rods 52 as seen in FIG. 2 includes an anchoring end portion for insertion in the bore hole and a tensioning end portion extending out of the bore hole. A bearing block retailing device is positioned on the tensioning end portion of the rod and includes an integral washer element 62 and an integral torque receiving end portion 64. The torque receiving end portion 64 extends axially from the washer element 62 in one embodiment and is recessed axially into the washer element 62 to form a socket in the washer element 62 in another embodiment. The washer element 62 abuts the bearing block 60 and has an outer diameter greater than the diameter of the hole through the bearing block 60 to prevent the rod 52 from passing through the opening in the bearing block 60. As will be described later in greater detail, the bearing block 60 is preferably fabricated of a non-metallic material such, as wood or plastic, corresponding to the material of the rod 52.

As further illustrated in FIG. 2, the rod 52 includes a shaft portion 66, also fabricated of a polymeric material such as plastic, having a preselected length corresponding to the length of the bore hole 54 and a uniform diameter. The shaft portion 66 includes a first end portion 68 integrally connected by molding to the washer element 62 and a second end portion 70. As shown in FIG. 1, the rod end portion 70 is advanced in the bore hole 54 to a position closely adjacent to the closed end 56 of bore hole 54. As shown in FIG. 3, the rod 52 may be fabricated with a pointed end portion 70 or in the alternative with a beveled end portion as illustrated in FIGS. 8–10.

The bore hole 54 is drilled into the rock formation at the respective pillar 18, 20 to a depth greater than the length of the shaft portion 66 of rod 52. In one example, the total length of the rod 52 is about six to eight feet where the length of the bore hole 54 exceeds the length of the shaft portion 66. In one example of use, the shaft portion 66 of the rod 52 is inserted into a $1\frac{3}{8}$ inches diameter bore hole 54, but the rod 52 may be used in a wide range of conventional bore hole diameters.

Figure 8:
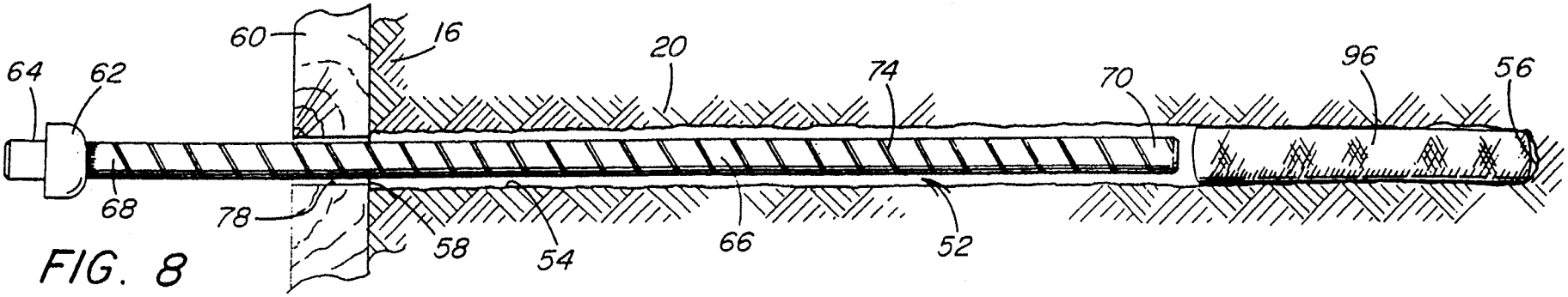
FIG. 8 is a partial sectional view in side elevation of the installation of the plastic rod in a bore hole, illustrating a resin cartridge advanced to the end of the bore hole and a block of wood positioned on the rod against the surface of the rock formation surrounding the bore hole.
Figure 9:
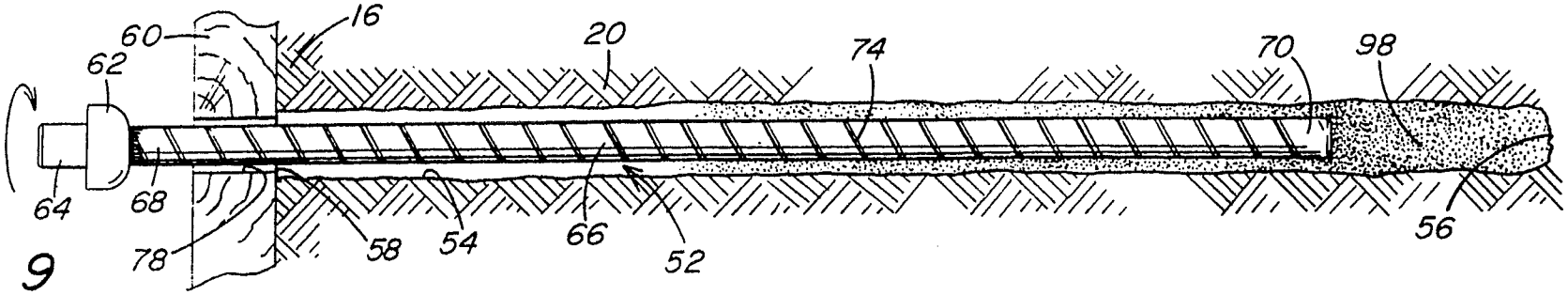
FIG. 9 is a view similar to FIG. 8, illustrating penetration of the end of the rod into the resin cartridge and rotation of the rod to mix the components of the ruptured resin cartridge.
Figure 10:
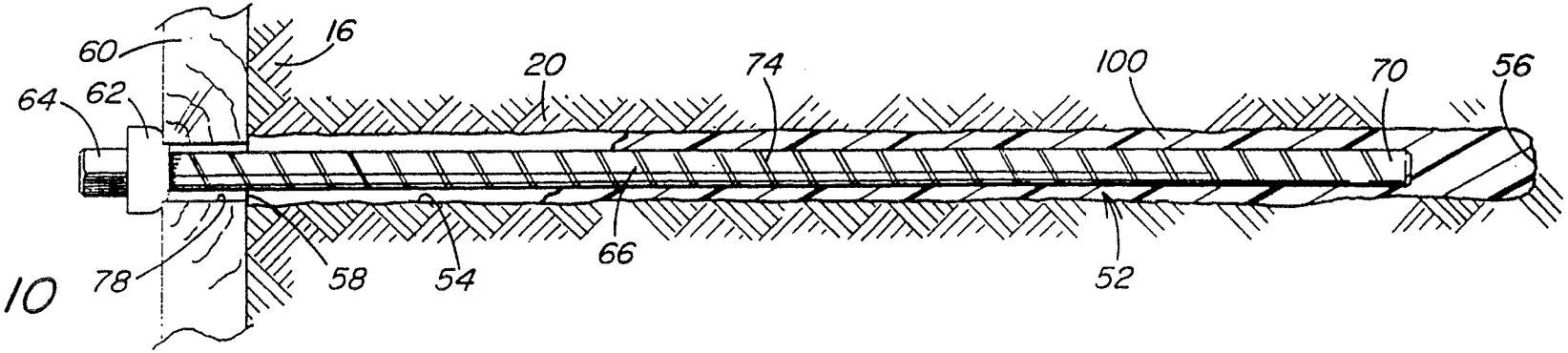
FIG. 10 is another partial sectional view in side elevation of the plastic rod, illustrating the rod anchored in the bore hole by the cured resin with the washer element compressing the bearing block against the rock formation.

Upon installation, as illustrated in greater detail in FIGS. 8–10, each anchor assembly 44–50 is secured within the bore holes 54 by a thermosetting resin material which is initially contained within a breakable cartridge inserted in the bore hole 54 ahead of the anchor assembly. Conventional mechanical expansion shell assemblies may also be used alone or in combination with a thermosetting resin material to secure the plastic anchor assemblies 44–50 in the rock formation at the ribs 18 and 20.

As well known in the art, the breakable resin cartridge contains a conventional two component bonding material, as disclosed, for example, in U.S. Pat. Nos. 3,324,662 and 3,394,527. As will be explained later in greater detail, the resin components are mixed when the cartridge is ruptured by axial advancement and rotation of the elongated rod 52 in the bore hole. After the resin 72 is mixed and cured, the elongated bar 52 is securely anchored within the bore hole 54 as seen in FIG. 1.

Figure 4:
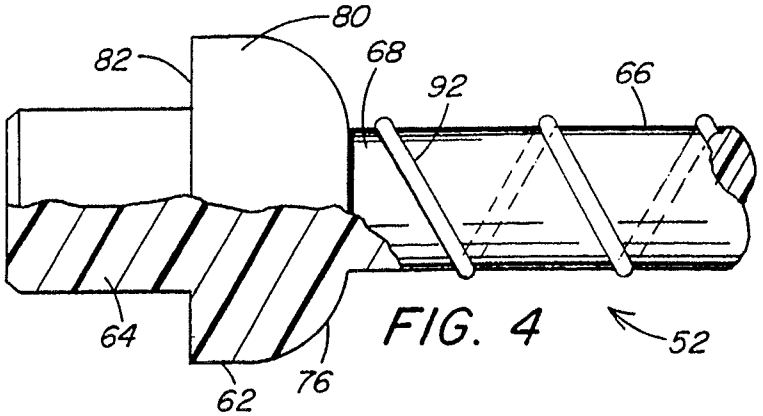
FIG. 4 is a fragmentary, partial sectional view of another embodiment of the plastic anchor rod, illustrating the integral construction of the shaft portion, washer element and torque receiving end portion with the shaft portion having a raised spiral rib extending on the surface thereof.
Figure 5:
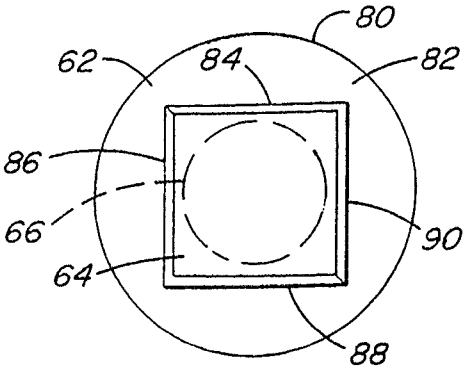
FIG. 5 is an end view of the plastic anchor rod shown in FIG. 4.
Figure 6:
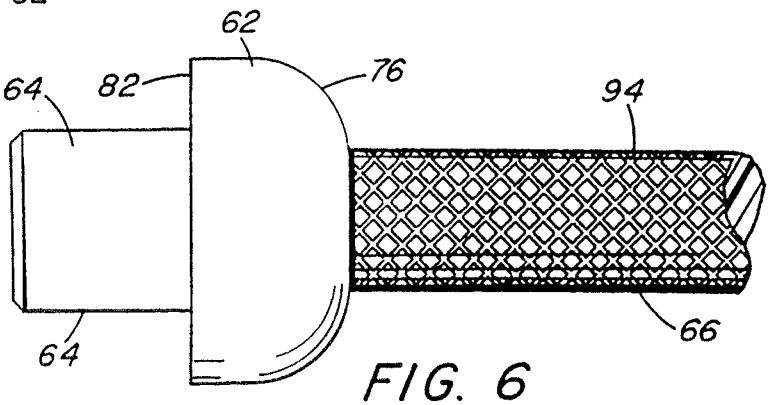
FIG. 6 is a fragmentary view in side elevation of a further embodiment of the plastic rod, illustrating a knurled surface on the shaft portion of the rod.
Figure 7:
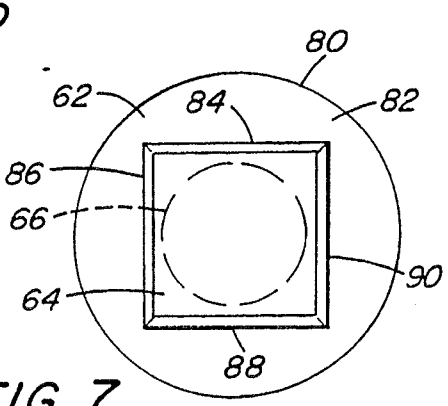
FIG. 7 is an end view of the plastic anchor rod shown in FIG. 6.

Preferably, the surface of the rod shaft portion 66 is provided with a textured pattern that extends a preselected length on the shaft portion 66. The type of textured pattern used is selective. In one embodiment grooves 74 are used, as shown in FIG. 2. Other types of extended surface patterns for the rod shaft portion 66 are shown in FIGS. 4 and 6. With a grooved pattern as shown in FIG. 2, a continuous helical indentation extends between the shaft end portions 68 and 70. The length of the textured pattern on the rod shaft portion 66 is also selective. As shown in FIG. 2, the groove 74 terminates at the washer element 62. As with the other components of the elongated rod 52, the groove 74 is integrally formed in the rod.

The helical groove 74 extending a preselected length on the shaft portion 66 serves to increase the area of contact of the mixed resin 72 in the bore hole 54 with the surface of the shaft portion 66. The mixed resin 72 flows over the surface of the shaft portion 66 and becomes embedded in the helical groove 74. Thus when the resin cures the shaft portion 66 is securely bonded to the cured resin and the resin is bonded to surface of the bore hole to securely anchor the rod 52 in the bore hole 54. Surface configurations other than a helical groove can be used as will be described later in greater detail with respect to the embodiments illustrated in FIGS. 4 and 6.

The elongated rod 52 is a unitary polymeric structure in which the shaft portion 66, washer element 62, and torque receiving end portion 64 are integrally formed in a plastic molding process. Preferably, the rod 52 is fabricated of a "plastic" or polymeric material. The composition of the polymeric material is selective. For example, in one embodiment the rod 52 is fabricated of glass reinforced polymers for high strength applications. A conventional pultrusion process is utilized to form the rod 52 of glass reinforced polymers. The use of glass reinforced polymers to fabricate the rod 52 provides the rod with high strength qualities adaptable for use of the rod 52 in anchor assemblies for supporting the roof of an underground passageway rather than the ribs or side walls of the passageway. For those applications where the rod 52 is used to support the side walls 14, 16 of the passageway 10, a plastic material having a material strength which is 15–25% of the material strength of a fiber glass reinforced is acceptable.

In the use of the reinforcing rod 52 as a "rib bolt" shown in FIG. 1, nylon or polyethylene terathalate is an acceptable material. In order to further reduce the fabricating costs of the rib bolt 52, scrap or recycled plastic materials are used. For example, plastic beverage containers formed of polymeric material selected from the group consisting of nylon and polyethylene terathalate are pulverized. The pulverized material is then recycled and combined in a plastic molding process to form the rod 52. Fabricating the rod 52 from this type of material substantially reduces the cost of manufacturing a reinforcing rod which has sufficient strength to support the ribs 18 and 20 of the formation surrounding the passageway 10. The plastic reinforcing rods 52 used as rib bolts are not required to have the strength requirements of roof bolts.

In the process of fabricating the integral reinforcing rod 52, a selected polymeric composition is utilized. Again, the polymeric composition of rod 52 varies from a high strength material, such as a glass fiber reinforced polymer, to a low strength material, such as recycled plastic scrap. Thus, the polymeric material used to fabricate the rod 52 is selective based on the material strength of the rod 52 required to exert a predetermined magnitude of reinforcement upon an underground formation. Accordingly, the magnitude of the reinforcement varies with the use of the rod 52. In those applications where the rod 52 is used to support the lateral ribs 18 and 20 or pillars of an underground rock formation or any other wall-like structure, low cost, recycled plastic material provides the rod 52 with the required material strength. On the other hand, overhead structures require greater reinforcement and plastic rods 52 used in this application must have a material strength greater than plastic rods 52 used to reinforce the side walls or ribs.

The reinforcing rod 52 of the present invention is fabricated of polymeric material with the components of the shaft portion 66, washer element 62 and torque receiving end portion 64 formed integrally with each other. In one method of fabrication, a conventional plastic rod composed of a low cost material, such as nylon or polyethylene, is heated to an elevated temperature to allow plastic flow of the material. The washer element 62 and the torque receiving end portion 64 are then formed on one end of the plastic rod by a conventional plastic forging or molding process. The washer element 62 and the torque receiving end portion 64 are forged to the desired configuration. In one embodiment, the torque receiving end portion 64 is formed to extend axially from the washer element 62. In another embodiment, the torque receiving end portion 64 is formed to extend axially into the washer element 62 to form a socket recess having a configuration adapted to receive the end of a torque wrench. In both embodiments, the torque receiving end portion 164 extends coaxially relative to the washer element 62.

The torque receiving end portion 64 shown in FIGS. 2 and 3 has a rectangular configuration adapted to mate with a torque wrench for transmitting torque to the rod 52 in the bore hole 54. However, the end portion 64 can be a socket in washer element 62. The molded unitary structure of the rod 52 eliminates the problems associated with prior art plastic bolts and rods having threaded ends to receive a separate nut to retain a bearing plate against the surface of the structure to be reinforced. By eliminating the need to thread the end 64 of the rod 52 and fabricate a separate nut or retaining element, the expense of fabricating the reinforcing rod 52 is substantially reduced. Installation of the reinforcing rod 52 is also made efficient by a reduction in the number of component parts of the anchor system.

The reinforcing rod 52 is provided with the integral washer element 62 having a preselected configuration with a cross sectional area greater than the cross sectional area of the opening in the bearing block 60, preventing the rod tensioning end portion from passing through the bearing block so that the bearing block 60 is retained on the shaft portion 66. As seen in FIGS. 2 and 3, the washer element 62 has adjacent the shaft end portion 68 a semi-spherical surface 76 having a radius of curvature adapted to sit within an opening 78 of the bearing block 60 as shown in FIG. 1. The curved surface 76 extends into the opening 78 to provide a firm engagement of the end of the rod 52 with the block 60 to, in turn, compress the block 60 against the surface of the side wall 14, 16. The radius of curvature of the semi-spherical surface 76 is selected so that it exceeds at its utermost diameter the diameter of the opening 78 in the bearing block 60. Thus, upon installation of the shaft portion 66 in the bore hole 54 the washer element 62 is firmly seated against the bearing block 60 in the opening 78 to retain the bearing block 60 on the rod 52.

The washer element 62 extends a preselected length on the end of the reinforcing rod 52 to an end portion 80 where the washer element has a maximum diameter as seen in FIG. 3. Accordingly, the washer element 62 progressively increases in diameter and cross sectional area from its point of connection to the rod end portion 68 to the opposite end portion 80. The end portion 80 of the washer element 62 terminates in a planar surface 82 which functions as an abutment surface to receive a torque transmitting wrench engaging the rod end portion 64. The torque receiving end portion 64 extends axially from the washer surface 82 or, in the alternative, is recessed axially through the surface 82 into the body of the washer element 62 to form a socket.

The torque receiving end portion 64 is an integral part of the washer element 62. The washer element 62 and end portion 64 serve the function of a threaded end portion and nut on a conventional bolt to retain a bearing plate or block on the reinforcing rod. The integral components of the present invention eliminate the need to thread the end of the rod and provide a mating nut. Further, on installation the operations of handling a separate nut and then threading the nut on the end of the bolt while maintaining the bearing plate on the end of the bolt until the nut is threaded in place is eliminated.

In accordance with the present invention, the integral components of the washer element 62 and the torque receiving end portion 64 on the shaft end portion 68 are not limited to a specific configuration. Because these components are molded or forged on the end portion 68, they are shaped as desired to hold a bearing block against the rock surface and receive torque from a torque transmitting device. By combining the versatility of the integral construction of the reinforcing rod 52 with the choice of polymeric materials for the rod composition, the plastic reinforcing rod 52 is useful in a wide range of applications for reinforcing an underground formation.

The plastic rod end portion 64 shown in FIGS. 2 and 3 has a rectangular configuration formed by the perpendicular, planar surfaces 84, 86, 88 and 90. Preferably, the planar surfaces 84–90 are equal in dimension to be engaged by a torque wrench for transmitting torque to the reinforcing rod 52. The end portion 64, washer element 62 and shaft portion 66 are coaxially aligned as seen in FIG. 3. With this arrangement, the end portion 64 is engaged by a torque transmitting device so that rotation imparted to the end portion 64 is transmitted to the shaft portion 66 to rotate the entire reinforcing rod 52.

The integral construction of the plastic reinforcing rod 52 is illustrated in detail in FIG. 4. The shaft portion 66 terminates at end portion 68 where the washer element 62 begins and expands radially outwardly from the shaft end portion 68. At this point, the diameter of the reinforcing rod expands to a maximum dimension where it extends axially for a preselected length to provide the washer element 62 with a desired length. It should be understood that the washer element 62 may be forged on the shaft end portion 68 with any desired configuration to accommodate secure engagement with a bearing block. Thus, the washer element 62 can be shaped to match the shape of the area around the hole 78 in tile bearing block 60 through which the rod 52 extends.

The semi-spherical surface 76 of the washer element 62 extends radially outwardly away from the shaft end portion 68 at the diameter thereof to a maximum diameter adjacent the torque transmitting end portion 64. At the juncture of the washer element 62 and end portion 64, the planar surface 82 extends perpendicular to the end portion 64. The end portion 64 is comprised of longitudinally extending planar faces 84–90 which are positioned perpendicular to one another to form the rectangularly shaped end portion 64. With this arrangement, the washer element 62 separates the rectangular end portion 64 from the cylindrical shaft end portion 68.

The planar faces 84–90 of the end portion 64 extend longitudinally a preselected length to accommodate engagement by a torque wrench. This permits a torque wrench to be advanced onto the end portion 64 until it abuts the planar surface 82 at the end of the washer element 62. In the alternative, a socket of desired configuration is recessed a preselected depth through the planar surface 82 into the washer element 62. In both of these embodiments, the provision of the washer element 62 integral with the shaft end portion 68 and the torque receiving end portion 64 eliminates the need for threading the end portion of the reinforcing rod 52 to receive a nut to retain the bearing block on the reinforcing rod 52.

The embodiment of the reinforcing rod 52 illustrated in FIG. 4 includes the feature of a raised helical rib 92 extending along the length of the shaft portion 66. The raised rib 92 serves a similar function as the helical groove 74 on the rod 52 shown in FIG. 2. The rib 92 provides an extended surface on the shaft portion 66 for contact with the mixed resin to insure secure bonding of the shaft portion 66 to the resin when cured.

The surface area of the rod shaft portion 66 is also increased by the provision of a knurled surface 94, as shown in the embodiment illustrated in FIG. 6. The knurled surface 94 is also integrally formed in the fabrication of the reinforcing 52 as are the helical raised rib 92 in FIG. 4 and the helical recessed groove 74 in FIG. 2. It should be understood that other extended surface configurations can also be utilized on the rod shaft portion 66 to increase the surface area to promote positive bonding of the shaft portion with the mixed resin material in the bore hole.

Now referring to FIGS. 8–10, there is illustrated the steps of illustrating the anchor assembly of the present invention comprising the elongated reinforcing rod 52 in a bore hole 54 at the side wall of an underground formation as shown in FIG. 1. Before inserting the reinforcing bar 52 into the bore hole 54, a conventional breakable resin cartridge 96 is inserted in the bore hole. The resin cartridge contains a conventional two component resin system retained in separate breakable containers within the cartridge 96. As well known, one container includes a polyester resin and the other contains a catalyst. The resin cartridge has a length of about two feet. More than one cartridge may be utilized in a bore hole depending upon the length of the bore hole and the strata characteristics of the surrounding formation. The cartridge 96 is advanced to the end 56 of the bore hole 54. Before the reinforcing bar 52 is inserted in the bore hole 54, the bearing block 60 is positioned on the shaft portion 66. As shown in FIGS. 8–10, the bearing block is preferably fabricated of wood when used at the side walls 14 and 16 of the passageway 10. A plastic bearing block can also be used.

In FIG. 1 individual bearing blocks 60 are shown for mounting on each reinforcing rod 52. It should also be understood that a single bearing block 60 may be used with more than one reinforcing rod 52. In this application, a bearing block in the form of a plank extends between two anchor assemblies. For example, rather than using individual bearing blocks 60 as shown in FIG. 1 for the anchor assemblies 44 and 46, a single bearing block in a form of a plank is held in place by the pair of assemblies 44 and 46 on the side wall 14. This arrangement provides an increased bearing force applied to the side wall 14 by extending the length of the bearing block in contact with the side wall. The same arrangement is utilized with the pair of anchor assemblies 48 and 50 on the opposite side wall 16, i.e. the anchor assemblies 48 and 50 extend through a plank which is compressed against the side wall 16.

An alternative arrangement includes the use of a single anchor assembly at each side wall 14 and 16 where the anchor assembly is centered on the side wall and extends through a plank that extends vertically a preselected length of the side wall. Thus, it should be understood that a selective number of arrangements of anchor assemblies in accordance with the present invention with selected types of bearing blocks, preferably wood, are used to support the side walls 14 and 16 of the passageway 10.

As shown in FIG. 8, the resin cartridge 96 is inserted in the bore hole 54 and advanced to the end 56 thereof by the reinforcing rod 52 which is extended through the bearing block 60 positioned adjacent the side wall 16. The rod end portion 70 is advanced in the bore hole 54 to compress the cartridge 96 against the closed end 56 of the bore hole 54. The rod 52 is further advanced to rupture the cartridge 96 as seen in FIG. 9. Thereafter, a torque is applied to the bar end portion 64 to rotate the entire anchor assembly in the direction indicated by the arrow in FIG. 9. Rotation of the rod 52 effects agitation of the polyester resin and catalyst so that the components are mixed to form a curable resin mixture 98 as illustrated in FIG. 9.

The resin mixture 98 by virtue of its physical characteristics is retained within the bore hole 54. As the rod 52 is advanced into the bore hole 54, the resin mixture 98 is displaced by the rod 52 in the bore hole. The mixed resin flows a considerable length along the rod 52 toward the opening 58 of the bore hole 54 but does not flow out of the bore hole 54. Prior to setting of the mixed resin 98, the rod 52 is advanced into the bore hole 54 until the washer element 62 is completely seated in the opening 78 in the bearing block 60. The rod 52 is rotated to mix the resin components and compress the bearing block 60 by the washer element 62 against the surface of the side wall 16, as shown in FIG. 10.

As the rod 52 rotates the curable resin mixture 98 flows into the fissures and faults in the rock formation 12 surrounding the bore hole 54. In this well known manner, the rock strata of the formation 12 are adhesively united to further reinforce the rock formation at the rib.

The rod end portion 64 is firmly held against the bearing block 60 compressed against the rib side wall for a short interval to allow the resin mixture to harden or cure in the bore hole 54. The resin mixture 98 surrounding the reinforcing rod 52 maintains the rod in position within the bore hole 54. After the resin mixture cures or hardens in the bore hole 54, the cured resin 100 securely retains the rod 52 in the bore hole. The rod 52 is thus anchored in the bore hole 54 with the wooden bearing block 60 compressed against the side wall 16 to reinforce the strata of the rib.

One of the problems encountered in using conventional metallic anchor assemblies at the side walls 14 and 16 to support the ribs 18 and 20 of a mine passage is damage to material dislodging equipment engaging the metallic bearing plates and anchor bolts. For example, if a cutter or shearer of a longwall mining machine contacts the metallic anchor assemblies at the side walls 14 and 16, substantial damage to the shearer can occur. In a longwall mining operation, a longwall panel having a transverse dimension of 600 to 800 feet is developed by forming a pair of longitudinally extending, spaced parallel entryways a considerable distance, e.g. 4,000 to 10,000 feet, into the seam of mine material.

The spaced, parallel entryways provide a working area for the passage of operating equipment, personnel, and supplies. Thus, the overhead roof and side walls must be reinforced by anchor assemblies. The parallel entryways are connected at their opposite end portions by cross entryways to form the generally rectangularly shaped longwall panel. A mine face is formed between and perpendicular to the spaced apart entries. A shearer-type cutting machine traverses the mine face between the entries. The shearer repeatedly traverses the length, of the mine face to dislodge the panel of material between the entries. As the panel is extracted, the side walls forming the panel are progressively removed.

In a conventional longwall mining operation, when the shearer traverses the panel, care must be taken to limit the travel of the shearer between the entries so that the shearer does not strike the metallic anchor assemblies reinforcing the side walls of the entries. If the rotating shearer contacts the metallic anchor assemblies, the shearer can be severely damaged causing time consuming repair and expense. It is also a known practice to progressively remove the side wall anchor bolts in advance of the traversing movement of the mining machine so that the shearer does not contact the bolts anchored in the side walls when the side walls are extracted. Removal of the side wall anchor bolts is also a time consuming task which interferes with the material dislodging operation.

In accordance with the present invention, the plastic anchor assemblies 44–50 are utilized to reinforce the side walls of the entryways surrounding a longwall panel to be extracted from the underground formation. The plastic anchor assemblies are installed so that the shearer can engage the anchor assemblies and disintegrate the anchor assemblies without causing damage to the shearer. In this manner, the plastic anchor assemblies are safely consumed and are not required to be removed.

Not only are the anchor rods 52 fabricated of consumable material, but the bearing blocks 60 as well. In one mode of operation, conventional wood bearing blocks 60 are used and in another mode polymeric bearing blocks 60 are used. In both modes, the bearing blocks 60 are capable of being left in place at the side walls with the anchor rods 52 and destroyed by the cutting action of the shearer in extracting the panel from the rock formation. It should be understood, in accordance with the present invention, that the material for the anchor rods 52 and bearing blocks 60 is selective within a range of materials having adequate strength to reinforce the side walls and capable of being destroyed or ground up by the cutting action of he mining machine without damaging the mining machine.

As the longwall panel is extracted by the transversing movement of the shearer, the plastic anchor assemblies are destroyed at the entry side walls. No damage is incurred to the shearer. As the longwall panel is progressively extracted, the anchor assemblies are no longer required for reinforcing the side walls which are progressively removed with the panel.

With this method and apparatus of the present invention, the side walls are reinforced by inexpensive polymeric anchor assemblies which are consumable without causing damage to the mining machinery in the extraction process. The shearer is operated without regard to the presence of the plastic anchor assemblies. No interruption in the mining operation is encountered to remove anchor assemblies. The plastic material forming the anchors is disintegrated, ground up and thereby consumed by the shearer. Elimination of metallic anchor assemblies and use of plastic anchor assemblies in accordance with the present invention eliminates a substantial expense and avoids damage to the mining equipment and costly down time.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically. illustrated and described.

We claim:

1. A method for fabricating a rod for use in reinforcing an underground rock formation comprising the steps of, molding polymeric material to form a reinforcing rod including an elongated shaft having a body portion of substantially uniform cross sectional area along the length thereof, forming one end portion of the shaft for insertion in a bore hole of an underground rock formation and a second end portion for extending out of the bore hole, forming integrally of polymeric material on the shaft second end portion a washer element having a semi-spherical surface facing the shaft second end portion, and forming integrally of polymeric material with the washer element a retainer for receiving torque to transmit rotation to the reinforcing rod when positioned in the bore hole of the underground rock formation.

2. A method as set forth in claim 1 which includes, forming the elongated shaft of polymeric material having a material strength required to reinforce the underground rock formation.

3. A method as set forth in claim 1 which includes, pulverizing plastic containers formed of polymeric material selected from the group consisting of nylon and polyethylene terathalate to form pulverized polymeric material, combining the pulverized polymeric material in a molding process to form the elongated shaft of polymeric material, heating one end of the elongated shaft to an elevated temperature, forging on the one end of the elongated shaft the semi-spherical shaped washer element, and forming integrally with the washer element the retainer where the shaft portion, washer element, and retainer are axially aligned and formed integrally.

* * * * *